US006978944B1

(12) United States Patent
Carey et al.

(10) Patent No.: US 6,978,944 B1
(45) Date of Patent: Dec. 27, 2005

(54) REVERSIBLE SPRAY TIP UNIT

(75) Inventors: Danuta H. Carey, Stockholm, NJ (US); Christopher M. Walsh, Florham Park, NJ (US)

(73) Assignee: American Products Company, Union, NJ (US)

( * ) Notice: Subject to any disclaimer, the term of this patent is extended or adjusted under 35 U.S.C. 154(b) by 0 days.

(21) Appl. No.: 10/886,857

(22) Filed: Jul. 8, 2004

(51) Int. Cl.[7] ..... B05B 15/02

(52) U.S. Cl. ..... 239/119; 239/600; 239/71; 29/281.5; 29/467; 29/890.143

(58) Field of Search ..... 239/119, 71, 72, 239/73, 600, 289, 580, 581.1, 106, 116, 115, 239/890.143; 29/285.1, 271, 239, 467, 464

(56) References Cited

U.S. PATENT DOCUMENTS 3,831,862 A * 8/1974 Calder ..... 239/119
4,516,724 A * 5/1985 Hellman ..... 239/119
4,537,355 A * 8/1985 Calder et al. ..... 239/119
4,611,758 A * 9/1986 Geberth, Jr. ..... 239/119
4,830,281 A * 5/1989 Calder ..... 239/119
4,971,249 A * 11/1990 Tam et al. ..... 239/119
5,280,853 A * 1/1994 Perret, Jr. ..... 239/119
5,294,053 A * 3/1994 Perret, Jr. ..... 239/119
5,340,029 A * 8/1994 Adams ..... 239/119
5,379,939 A * 1/1995 Perret, Jr. ..... 239/119
5,749,528 A * 5/1998 Carey et al. ..... 239/119
5,765,753 A * 6/1998 Kieffer ..... 239/119
5,810,256 A * 9/1998 Perret ..... 239/119
5,829,680 A * 11/1998 Perret, Jr. ..... 239/119
5,887,793 A * 3/1999 Kieffer ..... 239/119
5,947,381 A * 9/1999 Carey ..... 239/119
6,481,640 B1 11/2002 Carey et al.
6,702,198 B2 3/2004 Tam et al.
6,719,212 B1 * 4/2004 Leisi ..... 239/119

* cited by examiner

*Primary Examiner*—David A. Scherbel
*Assistant Examiner*—Seth Barney
(74) *Attorney, Agent, or Firm*—Bucknam and Archer

(57) ABSTRACT

There is provided a reversible spray tip unit for an airless spray gun having an axially rotatable cylindrically shaped turret member with the spray tip nozzle arranged in a diametric fluid bore therein, the turret member being disposed in a complementary shaped bore of a housing and arranged transverse to the flow of paint, and a saddle seal received axially in the housing and having a cylindrically shaped sealing face mating with the cylindrical shape of the turret member at the diametric fluid bore housing the spray tip nozzle. Upon assembly of the disassembled reversible spray tip unit, the saddle seal is quickly inserted into the housing and accurately oriented so that its sealing face is aligned with the cylindrically shaped bore in the housing for the turret member by means of an insertion/orientation tool which is adapted to be keyed to the fluid bore of the saddle seal.

6 Claims, 8 Drawing Sheets

REVERSIBLE SPRAY TIP UNIT

FIELD OF THE INVENTION

The present invention relates generally to spray tips for use in spray guns used in the hydraulic atomization and spraying of liquids such as paint wherein the spray tip is reversible so that obstructions therein which clog the spray tip may be easily removed by the reversed flow of the high pressure liquid paint there-through. More particularly, the present invention relates to a means for quickly and accurately assembling a disassembled reversible spray tip unit.

BACKGROUND OF THE INVENTION

The reversible spray tip unit or assembly with which the present invention is concerned is used in hydraulic or airless paint spraying and generally consists of a rotatable cylindrically shaped turret member arranged transverse to the flow of high pressure paint wherein a diametric fluid bore is provided for mounting of the spray tip or nozzle. A housing for the reversible spray tip unit is engaged by a securing nut which secures the spray tip unit to the discharge end of the spray gun. The spray tip unit housing permits the turret member to be axially rotated therein so as to present the spray tip forwardly for spray painting and rearwardly facing the discharge end of the spray gun so that clogs in the spray tip can be removed by the reversed flow of paint. A metallic, so-called saddle seal is received in an axial bore therefor in the spray tip unit housing so as to contact the face of the cylindrically shaped turret member at the diametric fluid bore therein. The sealing face of the saddle seal has a shape which is complementary to the cylindrical shape of the turret member and upstream therefrom an elastomeric sealing washer is arranged on the saddle seal which is compressed against the discharge end of the spray gun by the tightening of the securing nut. An axial fluid bore provided in the saddle seal delivers the high pressure fluid paint from the spray gun discharge to the fluid bore in the turret member. The spray tip unit housing is generally surrounded by a plastic tip guard having Y or V shaped forward extending ears. The turret member is provided with a T-shaped handle so that it may be easily rotated as required.

Because of the abrasive nature of all paints and coatings, wear necessarily occurs in the spray tip nozzle and the sealing faces of the turret member and saddle seal requiring replacement of the turret member containing a new spray tip nozzle and/or the saddle seal. In addition, it is frequently necessary during use of such reversible spray tip units to thoroughly clean the unit for one reason or another. As a result, such reversible spray tip units are frequently disassembled and reassembled by the painting operators during normal painting operations. This frequent disassembly and assembly of the reversible spray tip unit necessarily results in a significant amount of time being spent by the painting operator in not painting. Particularly time consuming during the assembly of the reversible spray tip unit is arranging the saddle seal in the saddle seal bore of the housing so that the cylindrically shaped sealing face thereof is properly aligned with the bore provided in the housing for the turret member. Since the saddle seal itself is generally cylindrically shaped as is the bore therefor in the housing, the proper orientation of the saddle seal within the bore so that the sealing face thereof aligns with the turret member bore is generally accomplished by trial and error. Thus, the operator must sight down the turret member bore during the insertion of the saddle seal and if the saddle seal is misaligned, a part of the edge of the sealing face will intrude into the bore and interfere with the insertion of the turret member. In that event, it is necessary for the operator to remove the saddle seal from the turret member housing and try again for proper alignment.

SUMMARY OF THE INVENTION

The primary object of the present invention is to provide a reversible spray tip unit for an airless spray gun having an axially rotatable cylindrically shaped turret member with the spray tip nozzle arranged in a diametric fluid bore therein, the turret member being disposed in a complementary shaped bore of the unit housing and arranged transverse to the flow of paint, and a saddle seal received axially in the housing and having a cylindrically shaped sealing face mating with the cylindrical shape of the turret member at the diametric fluid bore housing the spray tip nozzle, wherein upon assembly of the disassembled reversible spray tip unit, the saddle seal can be quickly inserted and precisely oriented to align the cylindrically shaped sealing face thereof with the cylindrically shaped bore in the housing for the turret member so that the turret member can be received in the housing bore therefor.

The above object is accomplished by providing the fluid bore of the saddle seal in the form of a keyway or key seat adapted to receive therein the key of an insertion/orientation tool. The insertion/orientation tool is provided for inserting the saddle seal into the saddle seal bore of the housing and because it is keyed to the fluid bore thereof, the saddle seal can be easily oriented within the saddle seal bore by the rotation of the insertion/orientation tool in the manner of a key which axially rotates the saddle seal within the bore therefor. Advantageously, the key of the insertion/orientation tool is formed as part of the turret member and preferably as one of the ends of the top cross member of the T-shaped handle and is arranged thereon so that when keyed to the fluid bore of the saddle seal the axial direction of the cylindrically shaped sealing face of the saddle seal is aligned with the axial direction of the turret member. Thus, upon insertion of the saddle seal into the saddle seal bore of the turret member housing, the alignment of the sealing face of the saddle seal with the turret member bore of the housing is easily accomplished by aligning the axial direction of the turret member connected to the T-shaped handle therefor parallel with the axial direction of the turret member bore of the housing.

BRIEF DESCRIPTION OF THE DRAWINGS

The present invention will be described and understood more readily when considered together with the accompanying drawings, in which.

DETAILED DESCRIPTION OF THE INVENTION

Figure 1:
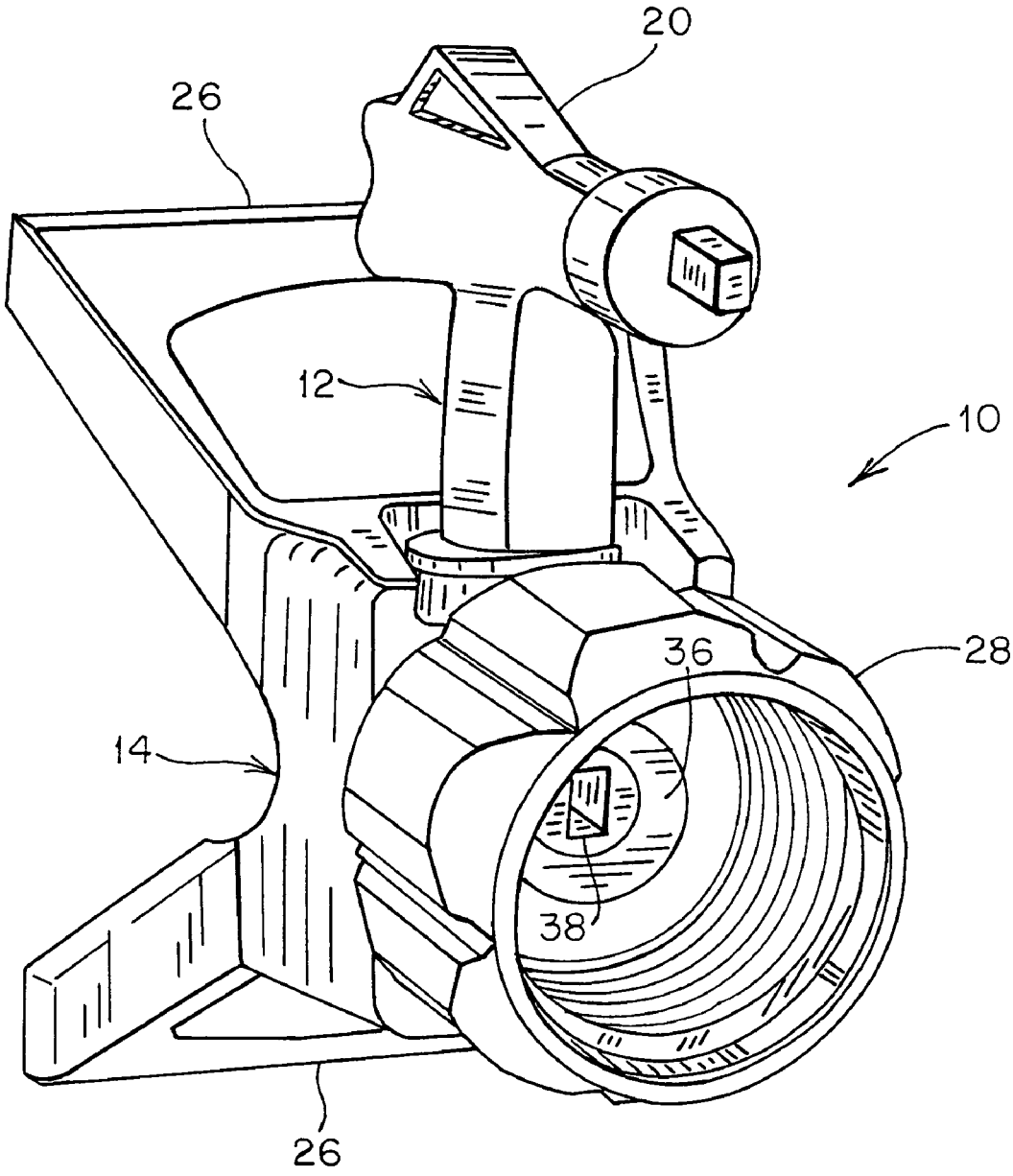
FIG. 1 is a perspective rear view of a reversible spray tip unit embodying the present invention.
Figure 2:
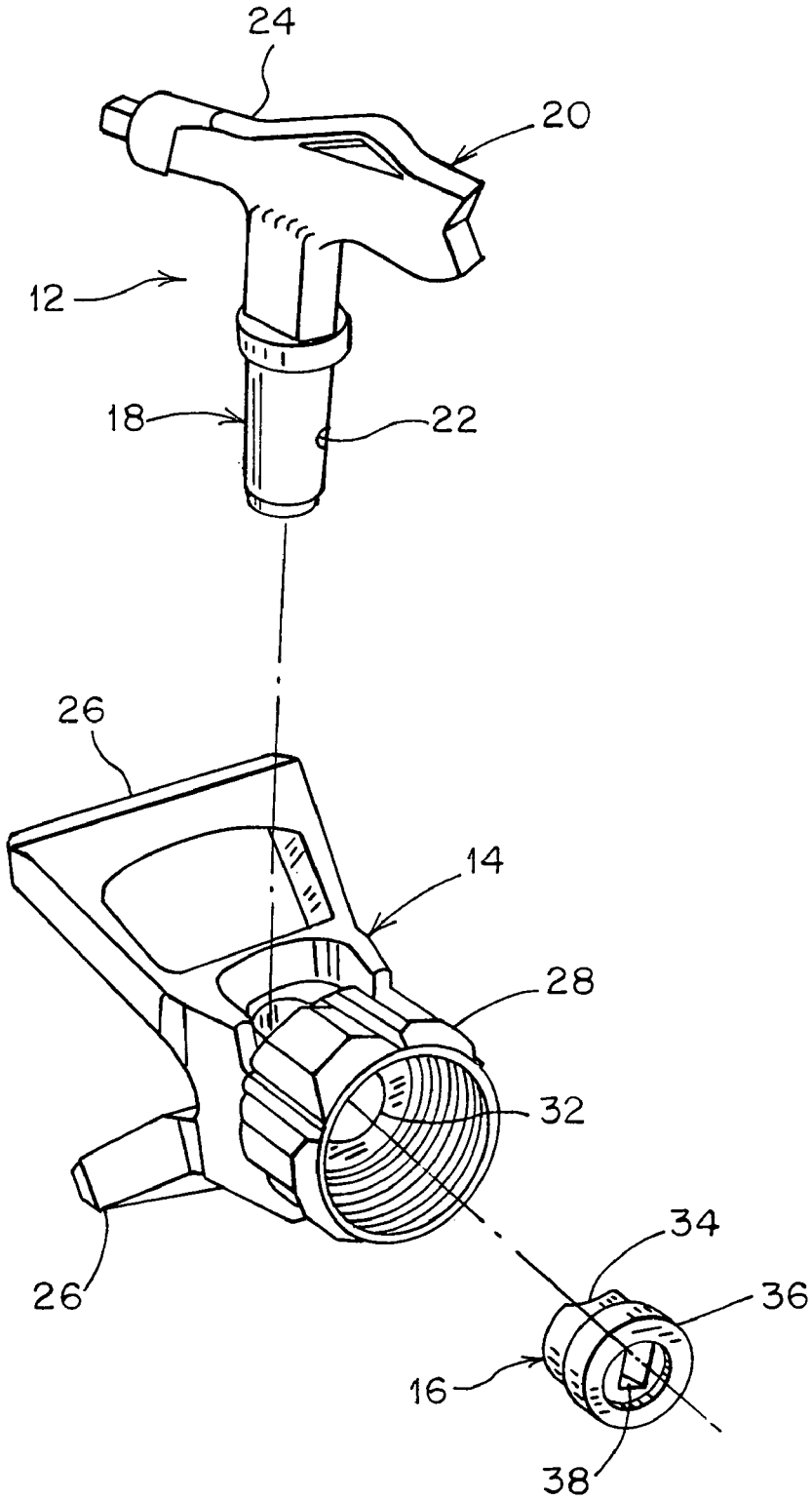
FIG. 2 is an exploded view of the reversible spray tip unit of FIG. 1.
Figure 3:
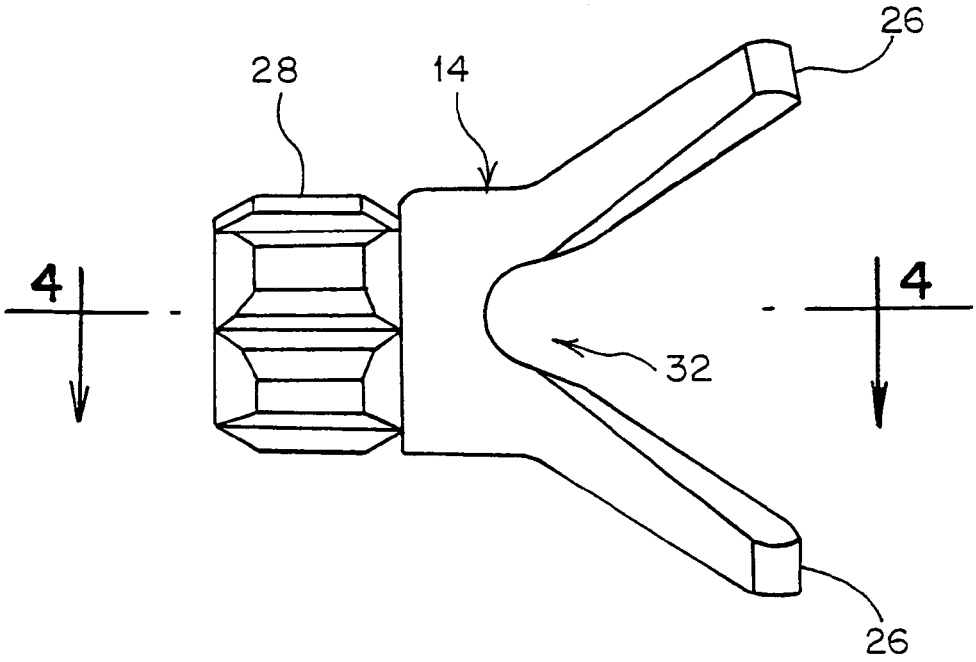
FIG. 3 is a side view of the reversible spray tip unit shown without the turret member.

Now turning to the drawings, there is shown in FIGS. 1 and 2, a reversible spray tip unit, generally designated 10, including a turret member 12, a spray tip unit housing 14 and a saddle seal 16. Turret member 12 includes a barrel shaped portion, designated 18, to an end of which is attached a T-shaped handle 20. Barrel portion 18 has a diametric through bore 22 formed therein at one end of which is housed the spray tip nozzle (not shown). As clearly seen in FIG. 2, the top cross member 24 of the T-shaped handle 20 is in alignment with bore 22 and advantageously, cross member 24 is provided with the general shape of an arrow wherein the point of the arrow indicates the exit direction of the spray tip nozzle. Thus, as seen in FIG. 1, the arrow shape of cross member 24 is pointed rearwardly indicating that the spray tip nozzle housed in turret member 12 is in reversed position facing the discharge end of a spray gun (not shown) to which reversible spray tip unit 10 is attached for clearing any clogs therein.

Spray tip unit housing 14 is provided with V or Y-shaped tip guard 26 and a securing nut 28 for securing the reversible spray tip unit 10 to the forward or discharge end of the spray gun. A cylindrically shaped transverse bore 30 is formed in housing 14, as clearly seen in FIG. 4, to receive barrel portion 18 of turret member 12 therein. An axial through bore 32 is provided in housing 14 in alignment with the spray gun discharge and in alignment with fluid bore 22 of turret member 12 when barrel 18 thereof is seated in bore 30 of housing 14.

Figure 4:
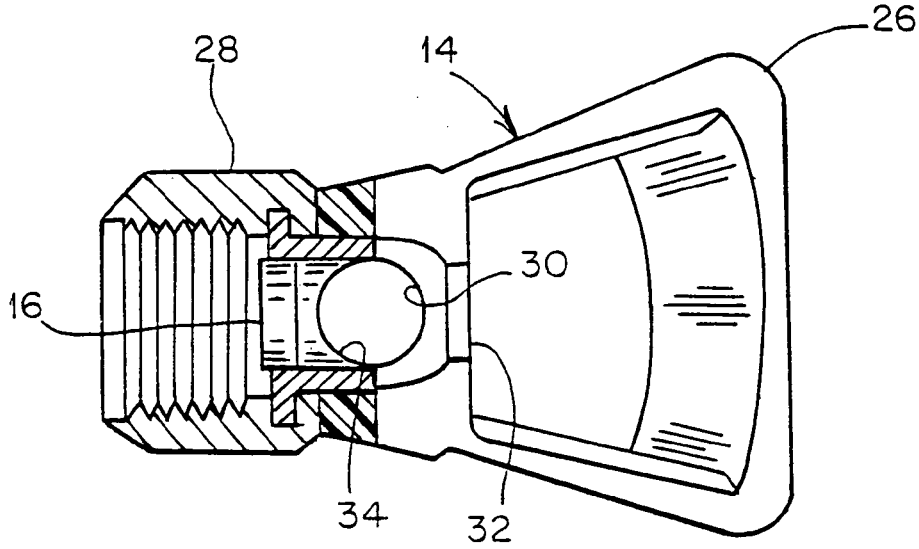
FIG. 4 is a cross sectional view of the reversible spray tip unit shown in FIG. 3 taken along the line 4—4 of FIG. 3.

Saddle seal 16, as clearly seen in FIG. 2, is received in the upstream end of bore 32 of housing 14 and when properly seated therein its cylindrically shaped sealing face 34 aligns with bore 30 as seen in FIG. 4. Saddle seal 16 is provided at its upstream end in contact with the discharge end of the spray gun with a resilient sealing washer 36 and has an axial fluid bore 38 therein which aligns with fluid bore 22 of turret member 12 when the reversible spray tip unit 10 is fully assembled.

Figure 5A:
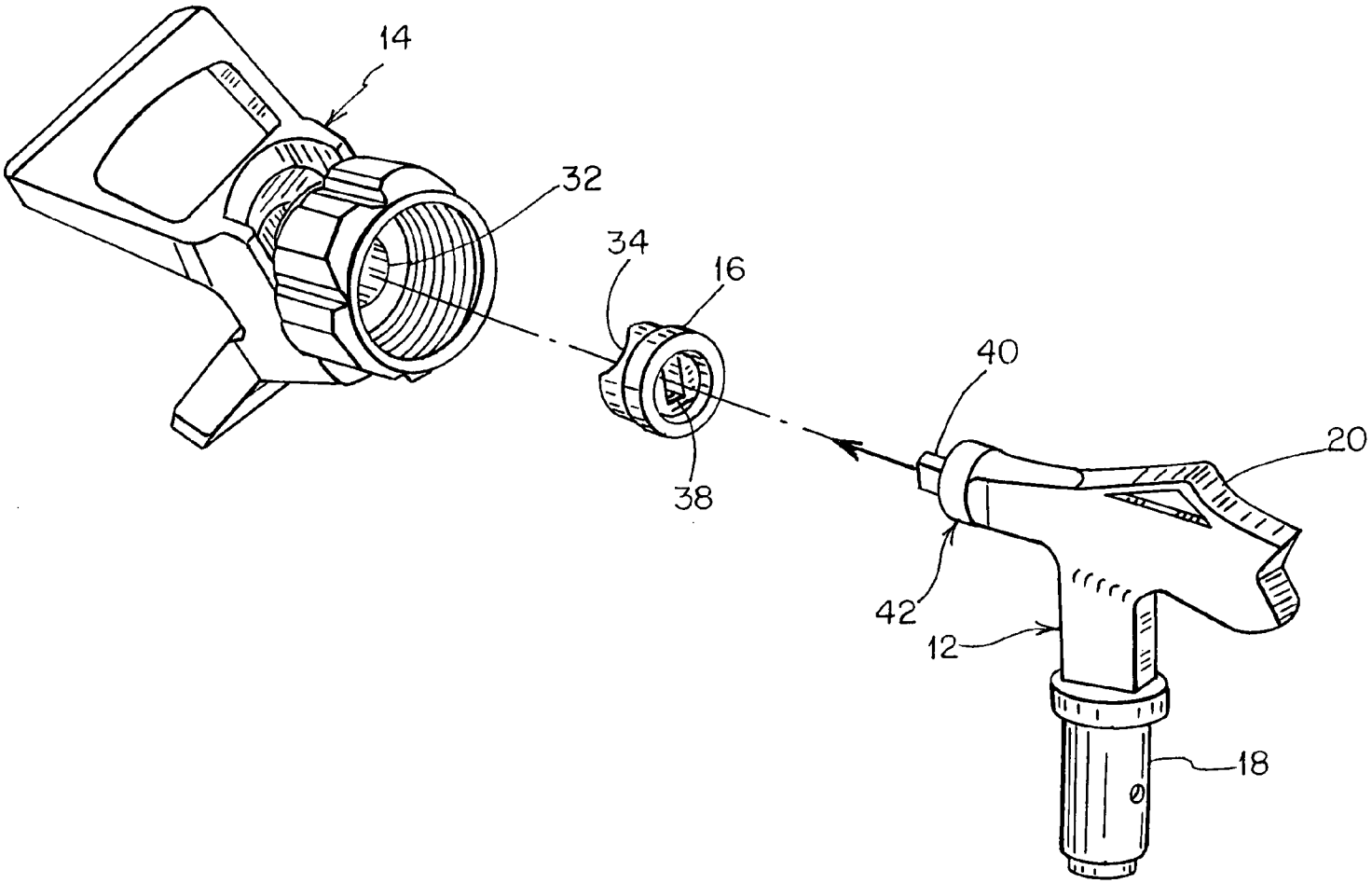
FIG. 5A is a perspective view showing the insertion/orientation tool aligned with the saddle seal which in turn is aligned for insertion into the spray tip unit housing.
Figure 5B:
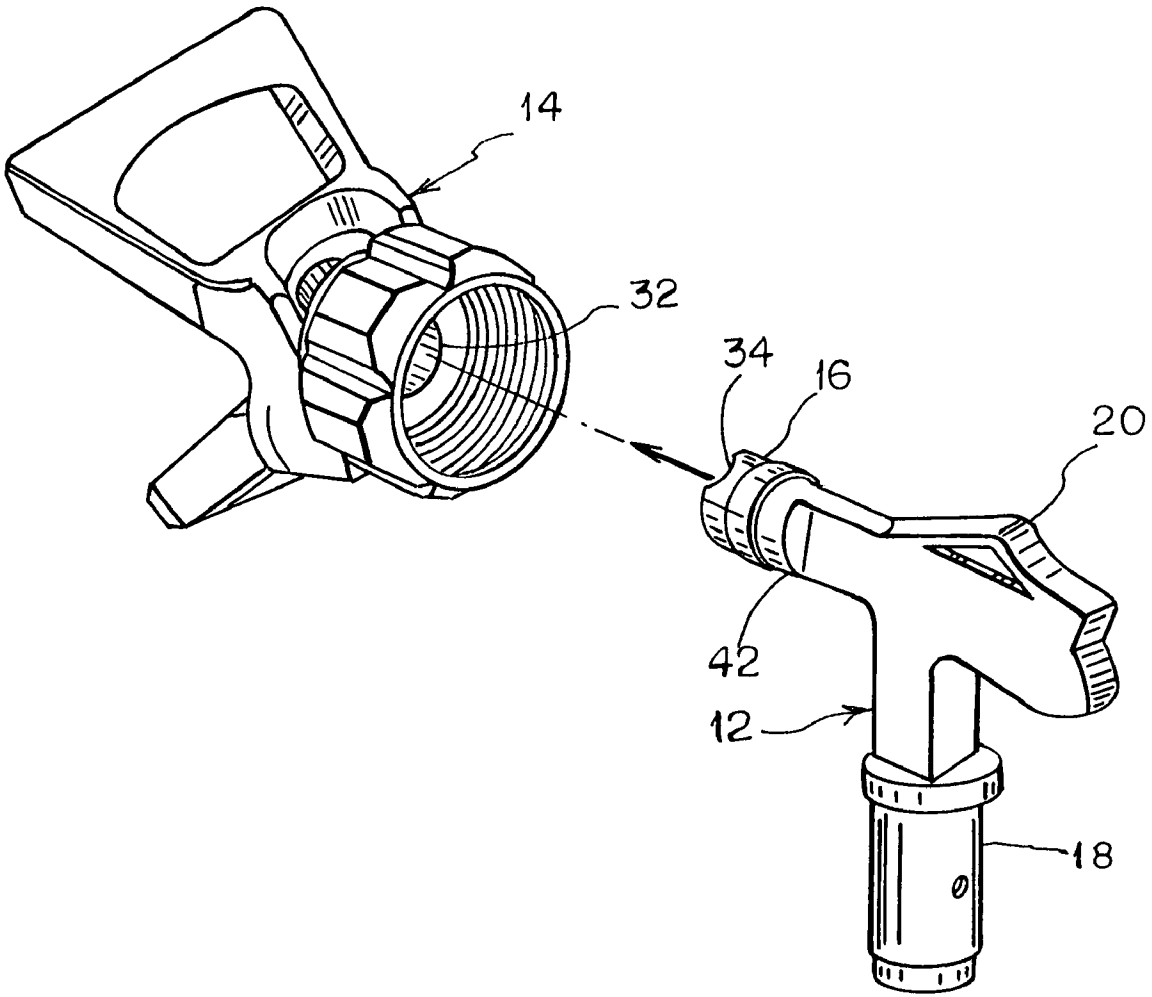
FIG. 5B is a view similar to FIG. 5A, showing the insertion/orientation tool cooperating with the saddle seal.
Figure 5C:
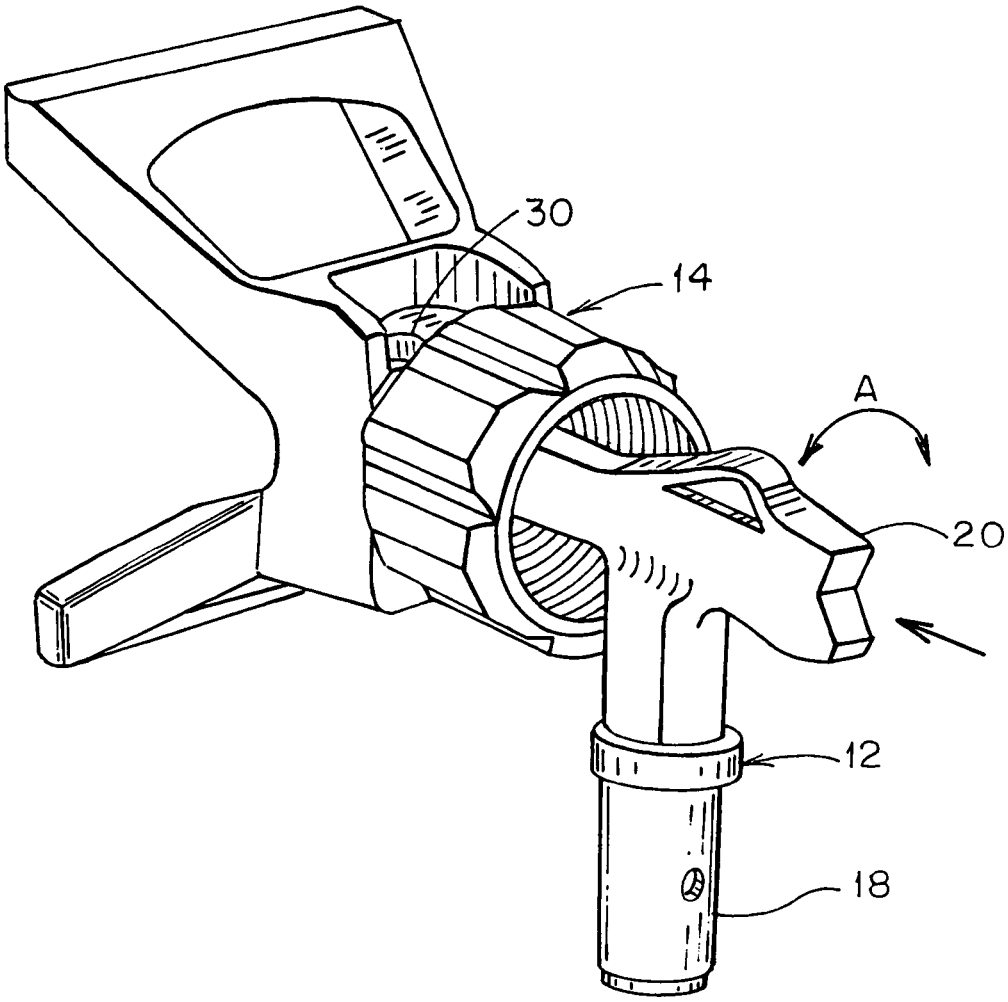
FIG. 5C shows the insertion/orientation tool inserting the saddle seal into the spray tip unit housing.
Figure 5D:
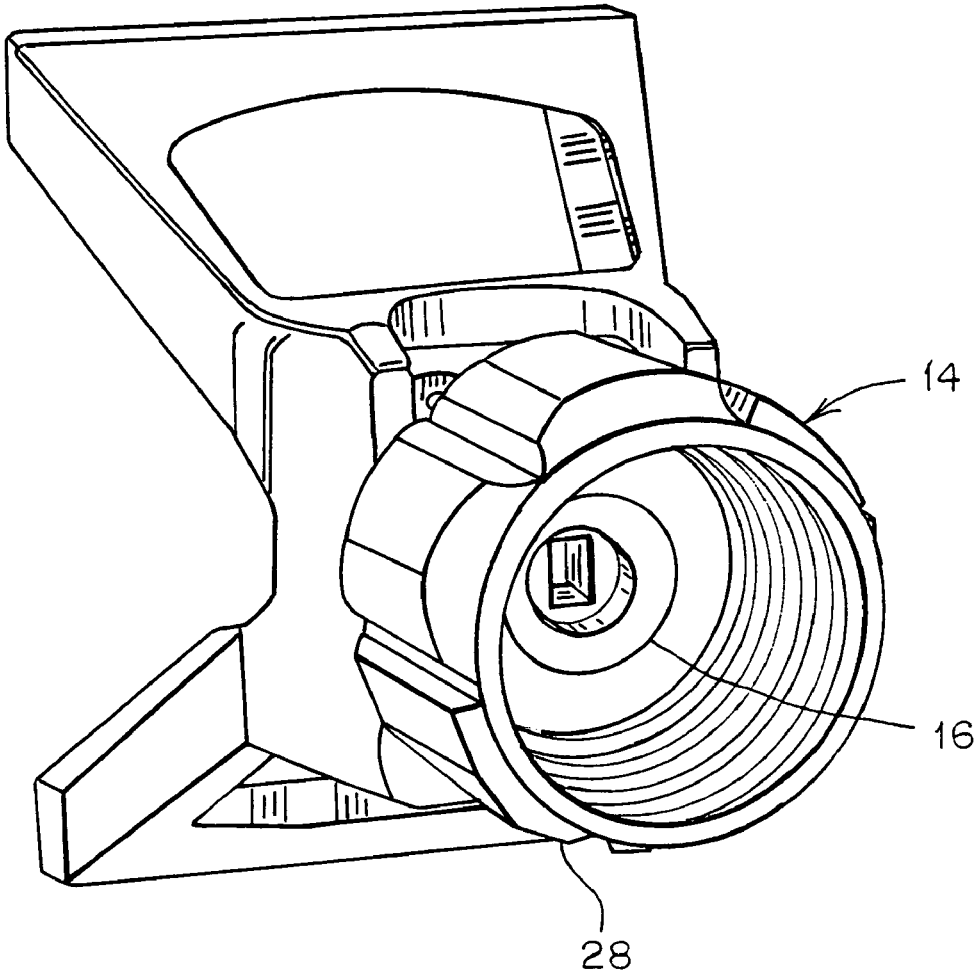
FIG. 5D is a perspective view showing the saddle seal seated in the spray tip unit housing.

FIGS. 5A to 5D show in accordance with the present invention, how saddle seal 16 is inserted into bore 32 of housing 14 and oriented therein so that the cylindrically shaped sealing face 34 thereof can be easily and accurately aligned with bore 30 of housing 14 as shown in FIG. 4. Thus, as clearly seen, fluid bore 38 of saddle seal 16 is shaped as a keyway or key seat so as to be keyed to key 40 of an insertion/orientation tool 42 so that the orientation of saddle seal 16 within bore 32 of housing 14 can be easily adjusted by rotating or turning tool 42 which in turn rotates saddle seal 16. The insertion/orientation tool 42 is advantageously formed as part of turret member 12 and preferably it is formed at one end of top cross member 24 of T-shaped handle 20. Key 40 of insertion/orientation tool 42 is oriented so that when it engages with and is keyed to the keyway of fluid bore 38, as clearly seen in FIG. 5B, the axial direction of cylindrically shaped sealing face 34 of saddle seal 16 is parallel to the axial direction of barrel 18 of turret member 12. Thus, as saddle seal 16 is inserted into bore 32 of housing 14, as shown in FIG. 5C, sealing face 34 can be aligned with bore 30 of housing 14 in one of two ways. The first is by visually sighting down bore 30 and axially adjusting the orientation of saddle seal 16 by turning turret member 12 in the direction of arrow A until sealing face 34 aligns with bore 30. The second way for accurately aligning sealing face 34 of saddle seal 16 with bore 30 is by aligning barrel 18 of turret member 12 parallel to bore 30 prior to insertion of the saddle seal whereby the axial direction of cylindrically shaped sealing face 34 is parallel to the axial direction of bore 30 of housing 14 and then inserting the properly oriented saddle seal.

Figure 6:
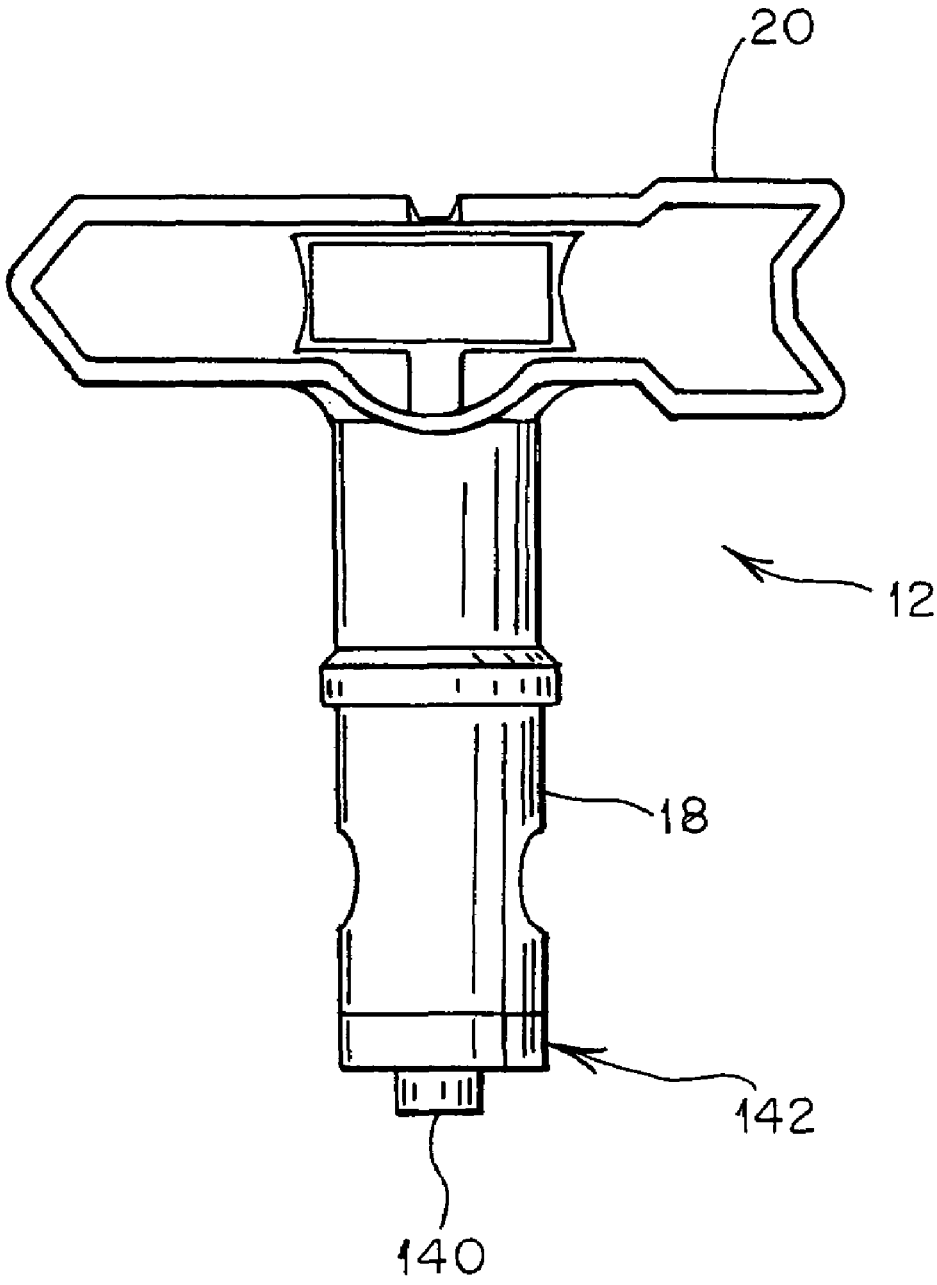
FIG. 6 is a side elevational view of a turret member incorporating another embodiment of insertion/orientation tool.

FIG. 6 shows another arrangement of the insertion/orientation tool whereby insertion/orientation tool 142 is arranged at an end of barrel shaped portion 18 of turret member 12 opposite T-shaped handle 20. Thus, key 140 of insertion/orientation tool 142 is disposed axially at the end of barrel shaped portion 18. In all other respects insertion/orientation tool 142 operates in the same manner as insertion/orientation tool 42, described above.

While only a single embodiment of the present invention has been shown and described, it will be obvious that many changes and modifications may be made thereunto without departing from the spirit and scope of the present invention.

What is claimed is:

1. In a reversible spray tip unit adapted to be secured to the discharge end of a spray gun for hydraulically atomizing and spraying liquid paint, the spray tip unit including a spray tip unit housing, an axially rotatable cylindrically shaped turret member with a spray tip nozzle arranged in a diametric fluid bore therein, the turret member being disposed in a complementary shaped bore of the unit housing arranged transverse to the flow of paint and having a T-shaped handle at an end of the turret member for the rotation thereof, and a cylindrically shaped saddle seal received in an axial bore in the unit housing and having a cylindrically shaped sealing face mating with the cylindrical shape of the turret member at the diametric fluid bore housing the spray tip nozzle, the saddle seal being provided with an axial fluid bore for communication between the spray gun discharge and the rotatable turret member, the improvement comprising:

an insertion/orientation tool for inserting said saddle seal into the axial bore therefor in said unit housing and orienting the saddle seal in the axial bore to align the sealing face thereof with the cylindrically shaped bore in the unit housing for said turret member, said orientation being accomplished by providing the fluid bore in said saddle seal with a keyway shape and the insertion/orientation tool with a key adapted to be keyed to the keyway shape of the saddle seal fluid bore, whereby the rotation of said insertion/orientation tool rotates said saddle seal.

2. The reversible spray tip unit as defined in claim 1, wherein said insertion/orientation tool is formed as part of said turret member/T-shaped handle combination.

3. The reversible spray tip unit as defined in claim 1, wherein said insertion/orientation tool is formed on an end of said turret member opposite the end of said turret member having said T-shaped handle.

4. The reversible spray tip unit as defined in claim 1, wherein said insertion/orientation tool is formed at one end of the top cross member of said T-shaped handle of the turret member.

5. The reversible spray tip unit as defined in claim 4, wherein the top cross member of said T-shaped handle is shaped as an arrow which points in the direction of exit from the spray tip nozzle and said insertion/orientation tool is located at the tip of said arrow.

6. The reversible spray tip unit as defined in claim 4, wherein the key of said insertion/orientation tool is arranged so that when keyed with the keyway of the fluid bore of said saddle seal, the axial direction of the cylindrically shaped sealing face of the saddle seal is parallel to the axial direction of the cylindrically shaped turret member.

* * * * *